United States Patent [19]

Maes et al.

[11] 4,428,731

[45] Jan. 31, 1984

[54] SMELTING FURNACE

[75] Inventors: Robert H. Maes, Hove; André L. Delvaux, Berchem; Pierre J. Lenoir, Edegem, all of Belgium

[73] Assignee: Metallurgie Hoboken-Overpelt, Brussels, Belgium

[21] Appl. No.: 363,814

[22] Filed: Mar. 31, 1982

[51] Int. Cl.³ ..... F27D 1/00; C21B 7/04

[52] U.S. Cl. ..... 432/247; 266/285; 373/72; 373/165

[58] Field of Search ..... 432/247, 251; 373/71, 373/72, 74, 137, 162, 164, 165; 266/285, 286

[56] References Cited

U.S. PATENT DOCUMENTS

| | | | |
|---|---|---|---|
| 1,099,559 | 6/1914 | Machalske | 373/72 |
| 1,239,214 | 9/1917 | Price | 373/82 |
| 2,101,786 | 12/1937 | Wise | 432/251 |
| 3,043,055 | 7/1962 | Davey | 432/251 |

*Primary Examiner*—John J. Camby

*Attorney, Agent, or Firm*—Fred Philpitt

[57] ABSTRACT

A smelting furnace, the refractory sole (3) of which is contained in a metallic casing (5) having expansion joints (6, 7, 7'), comprises means (18, 19) for cooling the expansion joints, these means enabling to solidify actually any liquid phase that might tend to infiltrate into the joints.

9 Claims, 3 Drawing Figures

SMELTING FURNACE

BACKGROUND OF THE INVENTION

The present invention relates to a smelting furnace comprising a sole made of a refractory material contained in a metallic casing with expansion joints, and elastic return means to have the casing following the contraction of the sole.

The aim of the expansion joints is to avoid destruction of the metallic casing by phenomenons of swelling, expansion and contraction of the refractory material, while the aim of the elastic return means is to allow the functioning of the expansion joints.

Such a furnace is described in Belgian Pat. No. 411 323. In this known furnace a sheet is inserted where the joints are provided, between the sole and the metallic casing so as to avoid that refractory material of the sole penetrates into the opening of the joints. No measure is taken, however, to avoid that liquid phase, that infiltrates into the refractory sole and reaches a joint, flows through this joint. This known furnace is thus not suited to carry out metallurgical reactions producing a liquid phase, the melting point of which is markedly lower than the reaction temperature, since under these conditions the liquid phase has a strong tendency to infiltrate deeply into the sole. Such a situation occurs, for instance, when lead bearing ores or concentrates are smelted to yield a slag phase and a lead bullion phase: the melting point of the slag requires an operating temperature of some 1,200° C., while the melting point of the lead bullion is about 330° C.

DISCLOSURE OF THE INVENTION

The aim of the present invention is to provide a furnace as defined before, avoiding the drawback of the known furnace.

Therefore, the furnace according to the invention comprises means to cool the expansion joints. These means enable to solidify actually all liquid metal that might tend to infiltrate through the joints.

Other details and characteristics of the invention will appear from the description of an embodiment of the furnace according to the invention, given hereafter as a non-resctrictive example and with reference to the enclosed drawings.

The same reference notations indicate identical elements in the different figures.

Figure 3:
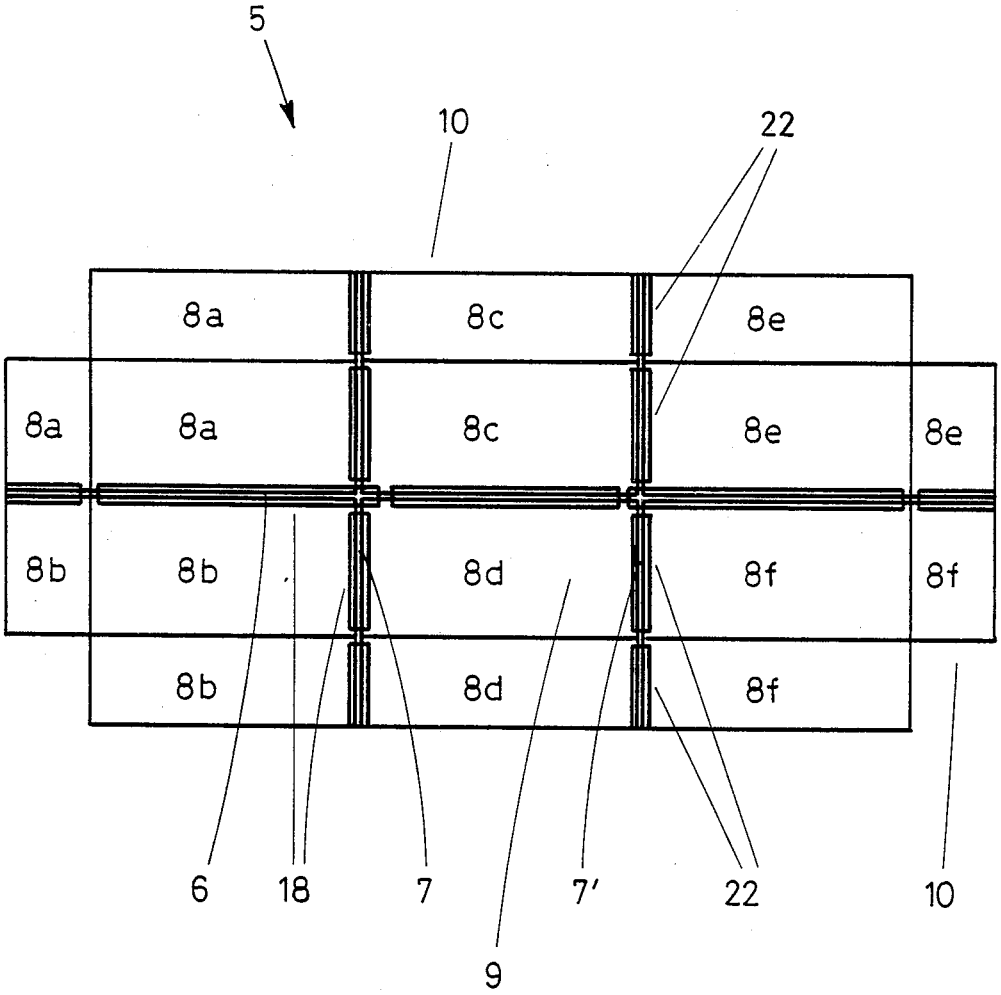
FIG. 3 represents a smaller scale development of the casing of the furnace of FIG. 1.

The furnace represented on the figures is a rectangular electric furnace with immerged electrodes that can be used to smelt lead bearing ores or concentrates. In that furnace the liquid bath 1, heated by electrodes 2, is contained by means of the refractory lining of sole 3 and of side walls 4. The refractory lining of the sole is enclosed in a casing 5, comprising a longitudinal expansion joint 6 and two transversal expansion joints 7 and 7' (see FIG. 3). Casing 5 is composed of several sections 8*a*, 8*b*, 8*c*, 8*d*, 8*e* and 8*f*, made of steel sheet, each of these sections being free to move individually; they form together bottom 9 and side walls 10. Bottom 9 of casing 5 rests on a set of beams 11 and 12. The expansions and contractions of the sole are controlled by means of beams 13 and tierods 14, through springs 15.

Figure 1:
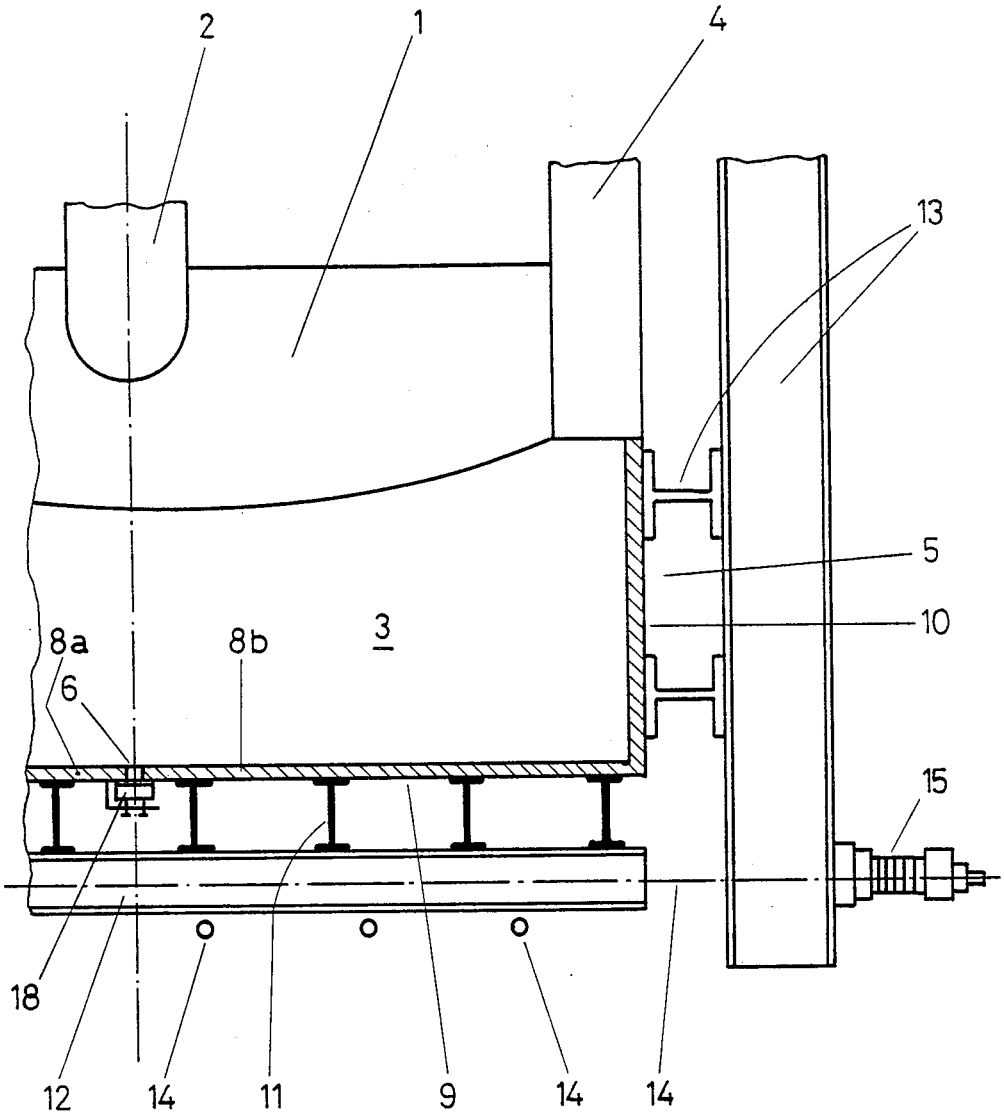
FIG. 1 represents part of a vertical section through a furnace according to the invention.
Figure 2:
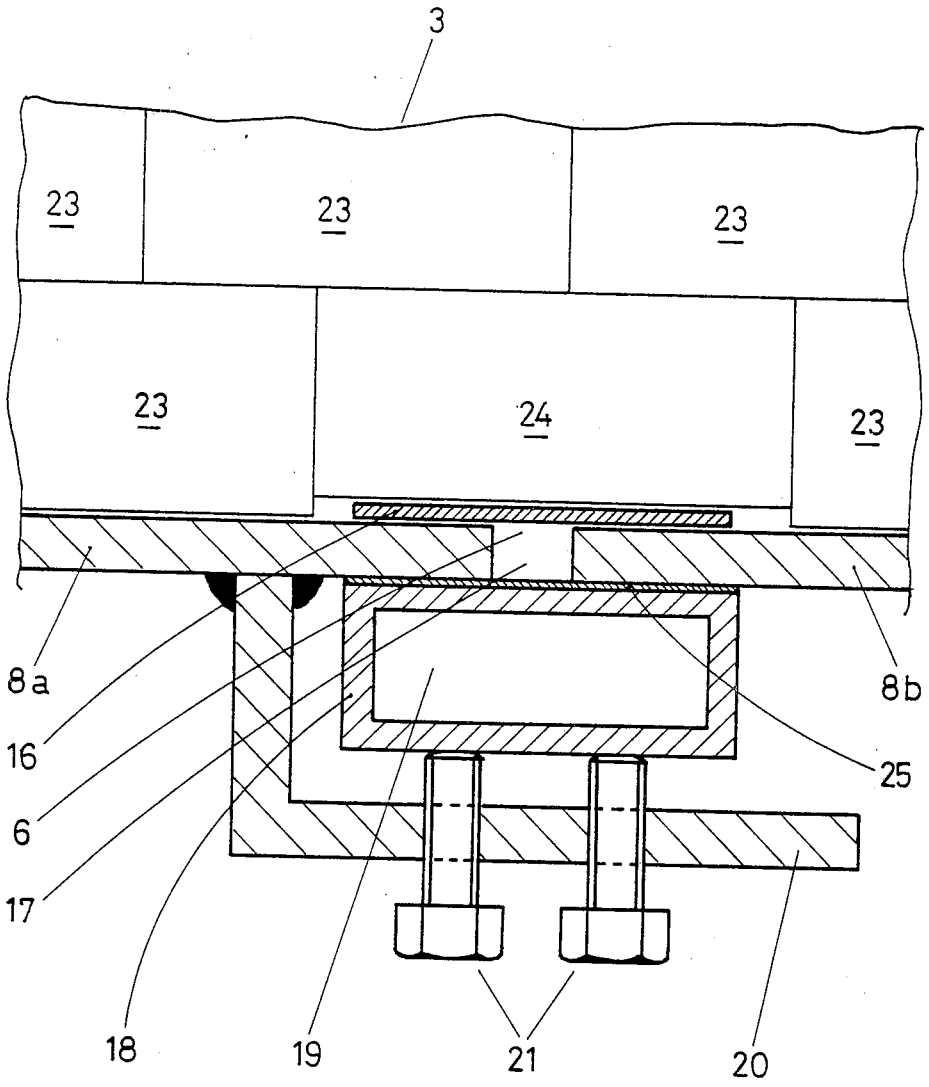
FIG. 2 represents an enlarged and more detailed view of an expansion joint of the furnace of FIG. 1.

As shown on FIG. 2, the junction between two adjacent sections, e.g. sections 8*a* and 8*b*, is realized by a metallic strap 16 placed between the refractory sole 3 and the edges of these sections that are situated along opening 17 between them. In this way the expansion joints 6, 7 and 7'are realized. The width of opening 17, that may be zero when the furnace is cold, increases with the temperature of the furnace. It is obvious that strap 16 should be wide enough, e.g. 20 cm, to remain always in contact with each of both adjacent sections, in the case of FIG. 2, sections 8*a* and 8*b*.

A hollow butt-strap 18, cooled by circulation of a cooling fluid 19 such as water, is applied on joints, 6, 7 and 7'. Butt-strap 18 is applied against joints 6, 7 and 7' by tightening bolts 21, borne by one side of an angle-iron 20, the other side of which is welded by its free end to one of the two adjacent sections. As shown on FIG. 3, the butt-straps 18 are composed of several rectilinear sections 22 which can be easily removed and replaced independently from each other, thanks to the system of fixation by tightening bolts, represented on FIG. 2.

The cooled butt-strap 18 creates in the refractory material of sole 3 near strap 16 a cold zone in which all liquid metal 1, that might have infiltrated into sole 3 until this zone, actually solidifies.

Sole 3 is made of bricks of a conventional material 23 with low thermal conductivity, such as magnesia, the thermal conductivity of which is ranging about 3 W/m°C. The entire sole may be of such material. It is particularly advantageous, however, to make the sole parts, which are close to the butt-straps 18, in a refractory material, the thermal conductivity of which is higher than 10 W/m° C., with a view to enlarge the cold zone created by the butt-straps. Bricks 24, that come into contact with straps 16, are thus preferably silicon carbide bricks, the conductivity of which is ranging about 20 W/m°C., or graphite bricks, the conductivity of which is ranging about 80 W/m°C.

Straps 16 may be made of steel, but are preferably made of a self-lubricating metallic material such as graphitic cast iron. Butt-strap 18 may be a steel section but its upper side that is turned towards casing 5 is advantageously covered by a strap 25 in a self-lubricating metallic material such as graphitic cast iron.

It should be understood that the invention is by no means restricted to the above described embodiment and that it can be modified in many ways without leaving the scope of the present patent application. So, for instance, the numer and disposition of the joints may be modified in function of the geometry of the furnace and the bricks placed near the silicon carbide or graphite bricks 24 may be also silicon carbide or graphite bricks.

What is claimed is:

1. A smelting furnace comprising in combination (a) a sole made of refractory material, (b) a metallic casing surrounding said sole, said metallic casing including a plurality of expansion joints, (c) elastic return means external of said metallic casing, which return means presses inwardly against said metallic casing so that said metallic casing will follow contractions of the sole, (d) a hollow butt strap abutting the exterior side of each expansion joint, and (e) means for introducing cooling fluid through each hollow butt strap so as to cool each expansion joint.

2. The furnace according to claim 1 wherein the butt-straps are in sections (22) adapted to be removed and replaced individually.

3. The furnace according to claim 2 wherein each butt-strap is held in place by tightening bolts (21) passing through one of the sides of an angle-iron (20) the other side of which is fixed by its free end to the metallic casing.

4. The furnace according to claim 2 wherein the portions of the sole that are in contact with the expansion joints are made of a material having a thermal conductivity higher than 10 W/m°C.

5. The furnace according to claim 2 wherein the inner sides of the expansion joints are covered by silicon carbide or graphite bricks.

6. The furnace according to claim 2 wherein the portion of the butt-strap that is in contact with the expansion joint is made of a self-lubricating metallic material.

7. The furnace according to claim 6 wherein the self-lubricating material is graphitic cast iron.

8. The furnace according to claim 2 wherein the joint parts (16) that are in contact with the refractory material of the sole, are made of a self-lubricating metallic material.

9. The furnace according to claim 8 wherein the self-lubricating material is graphitic cast iron.

* * * * *